United States Patent [19]

Rossi

[11] 4,208,181

[45] Jun. 17, 1980

[54] LIQUID METERING AND DISTRIBUTION ARRANGEMENT FOR ROTARY REACTOR

[75] Inventor: Eugene F. Rossi, Wauwatosa, Wis.

[73] Assignee: Allis-Chalmers Corporation, Milwaukee, Wis.

[21] Appl. No.: 960,091

[22] Filed: Nov. 13, 1978

[51] Int. Cl.[2] ..... F27B 7/20

[52] U.S. Cl. ..... 432/109; 266/96; 432/26; 432/51

[58] Field of Search ..... 432/26, 105, 109, 51, 432/54; 266/187, 173, 96; 239/417, 350

[56] References Cited

U.S. PATENT DOCUMENTS

| | | | |
|---|---|---|---|
| 2,091,850 | 8/1937 | Gohre | 432/109 |
| 3,182,980 | 5/1965 | Helfrich | 432/109 |
| 3,794,483 | 2/1974 | Rossi | 432/109 |
| 3,847,538 | 11/1974 | Rossi | 432/26 |
| 3,945,624 | 3/1976 | Rossi | 432/187 |
| 3,946,949 | 3/1976 | Rossi | 266/265 |

*Primary Examiner*—John J. Camby
*Attorney, Agent, or Firm*—Robert C. Sullivan

[57] ABSTRACT

Flow control valves are mounted with corresponding axial rows of nozzles about the periphery of a rotary kiln. A metering cylinder is mounted on the kiln and rotates therewith. A piston member is moveable in the metering cylinder in alternately opposite directions to deliver a predetermined measured volume of a liquid hydrocarbon such as fuel oil from said cylinder equally in each direction of movement of said piston member. A first hydraulic circuit interconnects each of said liquid flow control valves with a liquid fuel supply and with one end of said metering cylinder on one side of said piston member, and a second hydraulic circuit interconnects each of said liquid flow control valves with an opposite end of said metering cylinder on an opposite side of said piston member and with a plurality of nozzles in the row of nozzles corresponding to the given flow control valve. Means is provided to selectively move each flow control valve to an "ON" position to permit hydraulic flow through said first and said second hydraulic circuits of the respective flow control valve when the given row of nozzles corresponding to the given flow control valve moves to a first predetermined location under a bed of metallic oxide, and to move each flow control valve to an "OFF" position to prevent hydraulic flow through said first and said second hydraulic circuits of the respective flow control valve when said given row of nozzles moves to a second predetermined location under the bed of metallic oxide.

14 Claims, 3 Drawing Figures

LIQUID METERING AND DISTRIBUTION ARRANGEMENT FOR ROTARY REACTOR

TECHNICAL FIELD

This invention relates to a system and apparatus for metering and distributing liquid to a rotary reactor such as a rotary kiln or the like and more particularly to a system and apparatus for distributing and metering precisely controlled quantities of liquid to a rotary reactor. The invention will be described as embodied in a system and apparatus for metering and distriburing precisely controlled quantities of liquid fuel, such as liquid hydrocarbon, to the nozzles of a rotary reduction kiln.

DESCRIPTION OF THE PRIOR ART

It is known in the prior art, as taught by U.S. Pat. No. 3,182,980 issued to Wayne J. Helfrich on May 11, 1965, to reduce iron ore to a lower state of oxidation by injecting a gaseous hydrocarbon fuel through kiln nozzles as they are passing beneath the charge or bed of iron ore in a rotating kiln, and also to inject into the kiln a gaseous oxidizing agent such as oxygen or air when the nozzles of the kiln are in an appropriate position such as above the bed of ore. It is also broadly known in the prior art to inject a liquid hydrocarbon such as fuel oil or the like into a rotary reduction kiln beneath the bed of ore, the liquid hydrocarbon serving as a reducing agent which causes a reduction of the iron ore to a lower state of oxidation. My prior U.S. Pat. No. 3,946,949 issued on Mar. 30, 1976, shows a nozzle suitable for injecting a liquid hydrocarbon such as fuel oil into the interior of a rotary reduction kiln beneath the bed of iron ore which is being reduced.

A problem which has been encountered in attempts to use liquid hydrocarbon as the reducing agent in a rotary reduction kiln is that it is difficult to precisely control the volume of the relatively small quantity of liquid hydrocarbon such as fuel oil which is injected into the rotary reduction kiln during each cycle of rotation of a particular nozzle or row of nozzles.

Accordingly, it is an object of the present invention to provide a system and apparatus for metering and distributing precisely controlled quantities of liquid into the interior of a rotary reactor such as a rotary reduction kiln.

It is another object of the present invention to provide a system and apparatus for metering and distributing precisely controlled quantities of liquid fuel such as a liquid hydrocarbon or the like into the interior of a rotary reduction kiln.

It is a further object of the invention to provide a liquid fuel distribution and metering arrangement which has particular utility for use on a rotary reduction kiln or the like, although not restricted to such use, including a metering device which can be adjusted to dispense a predetermined precise volume of liquid fuel through the nozzles of the rotary reduction kiln.

It is a further object of the invention to provide an arrangement and apparatus which has particular utility for use in distributing and metering liquid fuel through the nozzles of a rotary reduction kiln or the like, although not restricted to such use, in which the operation of the metering device can be observed visually and in which the metering device is easily adjustable to permit variation in the quantity of liquid fuel dispensed through the nozzles of the rotary reduction kiln or the like on each cycle of rotation of the kiln.

In achievement of these objectives, there is provided in accordance with the invention a rotary reactor comprising an elongated cylindrical chamber adapted to have a charge of material to be processed contained therein, a plurality of nozzles supported by said rotary reactor in fluid communication with said chamber, said nozzles being positioned about the periphery of said rotary reactor in substantially equally angularly spaced relation to each other, a separate liquid flow control valve associated with and corresponding to each of said nozzles, each of said flow control valves being mounted on and rotatable with said rotary reactor, a metering cylinder mounted on said rotary reactor and rotatable therewith, a piston member movable in said cylinder in alternately opposite directions to deliver a predetermined measured volume of liquid from said cylinder equally in each direction of movement of said piston member, a first hydraulic circuit interconnecting each of said liquid flow control valves with a liquid fuel supply and with one end of said metering cylinder on one side of said piston member, a second hydraulic circuit interconnecting each of said liquid flow control valves with an opposite end of said metering cylinder on an opposite side of said piston member and with the nozzle corresponding to the given flow control valve, means adapted to selectively move each flow control valve to an "On" position to permit hydraulic flow through said first and said second hydraulic circuits when the given nozzle corresponding to a given flow control valve moves to a first predetermined circumferential position relative to the charge of material in said chamber, and to move each flow control valve to an "Off" position to prevent hydraulic flow through said first and said second hydraulic circuits when said given nozzle moves to a second predetermined circumferential position relative to the material in said chamber, the hydraulic connections of said first and said second hydraulic circuits between said metering cylinder and the flow control valves of alternate circumferentially spaced nozzles being reversed as compared to each other whereby to cause said piston member to move in said metering cylinder in alternately opposite directions to deliver a predetermined measured volume of liquid from alternate sides of said piston to alternate circumferentially spaced nozzles.

Further objects and advantages of the invention will become apparent from the following description taken in conjunction with the accompanying drawings in which:

DESCRIPTION OF THE PREFERRED EMBODIMENT

Figure 2:
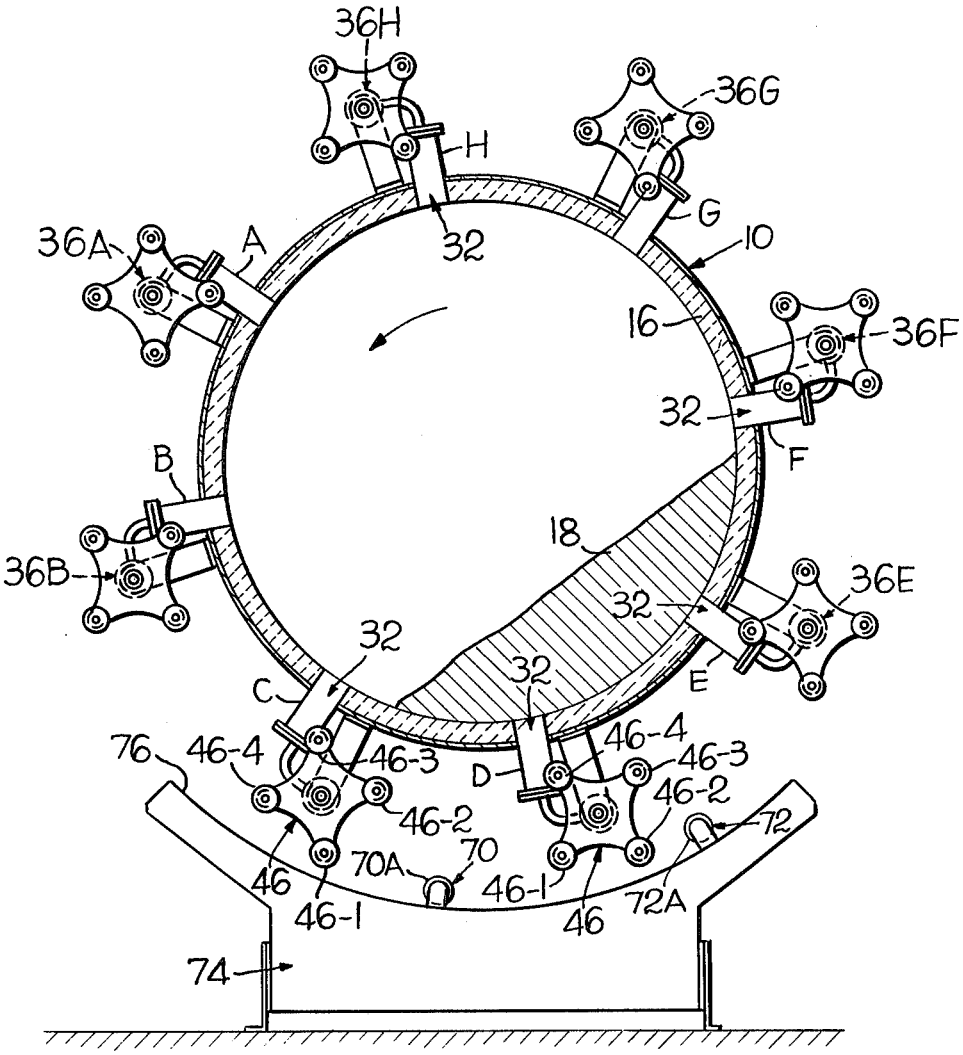
FIG. 2 is a partial sectional view of a rotary reduction kiln having the apparatus of the invention mounted thereon.

Referring now to the drawings, there is shown a rotary reduction kiln generally indicated at 10 which comprises an elongated cylindrical body portion 12 which defines a cylindrical reduction or combustion chamber 14. The general arrangement and construction of rotary kilns of this type are well known per se and are shown, for example, by such prior art patents as the aforementioned U.S. Pat. No. 3,182,980 issued to Wayne J. Helfrich, and also by my U.S. Pat. Nos. 3,794,483, 3,847,538 and 3,945,624. The shell or inner wall of the kiln may be constructed of any suitable refractory material such as firebricks. Any well known means may be provided for supporting and rotating the kiln such as that shown, for example, by the aforementioned U.S. Pat. No. 3,182,980 of Wayne J. Helfrich. Since such means form no part of this invention and are well known in the art, they are not shown herein. A charge of metallic oxide to be reduced to a lower state of oxidation generally designated at 18 is shown in FIG. 2. In most cases, the metallic oxide 18 to be reduced would be an iron oxide in the form of lump ore or alternatively in the form of pellets. However, the metallic oxide to be reduced could also be oxide of some other metal such as nickel.

A main burner 20 is provided at the left-hand end of the kiln relative to the views shown in the drawings to preheat the kiln, as is well known in the art. Main burner 20 is preferably stationary and kiln 10 rotates with respect to the stationary burner. The construction or arrangement of main burner 20 has no connection or relation with the invention.

The liquid fuel such as a liquid hydrocarbon or fuel oil is supplied to rotary reduction kiln 10 from a supply source generally indicated at 22 which includes a liquid fuel reservoir R, a pump P for pumping liquid from the reservoir and suitable pressure regulating means PR for controlling the fuel supply pressure in the stationary supply conduit 24 which extends from fuel supply 22. Stationary supply conduit 24 is connected by a rotary union 26 to input conduit 27 mounted on and carried by rotating kiln 10. Input conduit 27 carried by kiln 10 lies along the axis of rotation of the kiln and is connected by a radially extending conduit 28 to a circular oil supply manifold S which is mounted on and rotates with kiln 12. Circular oil supply manifold S extends circumferentially in a closed circle around the entire circumferential periphery of kiln 10.

Figure 1:
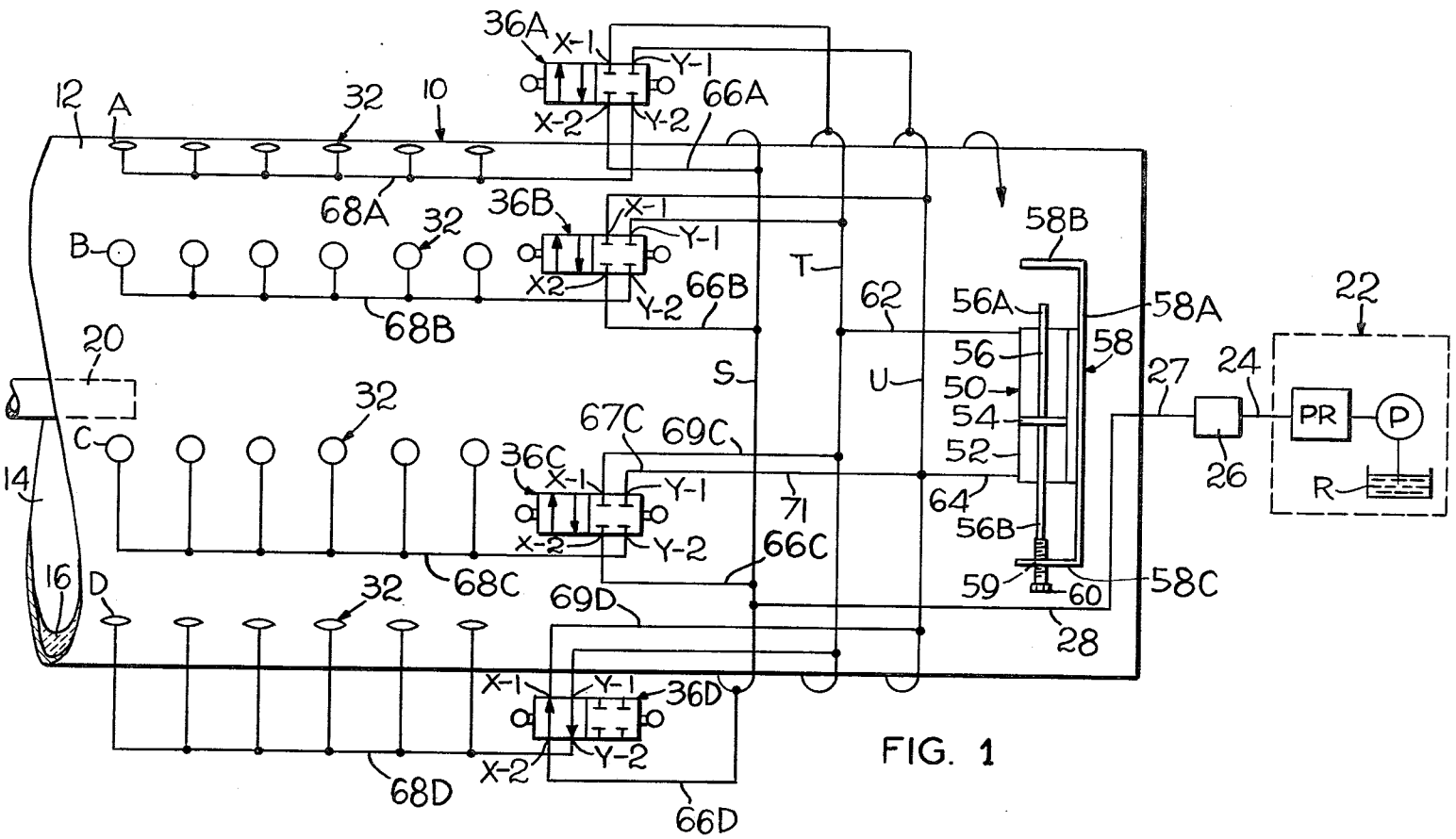
FIG. 1 is an elevation view, partially schematic, of a rotary reduction kiln provided with the fuel metering and distributing arrangement of the invention.

A plurality of inlet nozzles 32 are mounted on kiln 10, each nozzle 32 extending from the exterior of kiln 10 through the refractory wall 16 of the kiln and into communication with the interior of the kiln where the nozzles are so positioned as to inject the hydrocarbon liquid such as fuel oil into the bed 18 of ore or pellets as the respective nozzles rotate or pass under the bed 18 of ore or pellets as will be described more fully hereinafter. The nozzles generally indicated at 32 may be of the type shown in my prior U.S. Pat. No. 3,946,949 referred to hereinbefore. As best seen in the views of FIGS. 1 and 2, the plurality of nozzles 32 in the particular embodiment shown are arranged in eight rows A–H, inclusive, extending longitudinally of the kiln in a direction parallel to the axis of rotation of the kiln, with the respective rows being spaced apart 45 degrees from each other relative to the circumference or periphery of the kiln.

Each of the axially extending rows of nozzles A–H, inclusive, in the illustrated embodiment is shown as including six nozzles. The plurality of nozzles in a given row, such as row A, are connected to a fluid manifold such as that indicated at 68A for row A. Manifold 68A supplies the liquid hydrocarbon to each of the nozzles 32 in the given row such as row A. A corresponding flow control valve generally indicated at 36 mounted on and rotatable with kiln 10 is provided to control the flow of liquid fuel to each of the nozzles 32 in a given longitudinal row of nozzles such as row A, B, etc., the specific flow control valve 36 for each of the respective rows, A, B, etc., being designated by the reference number "36" together with a letter corresponding to the row of nozzles controlled by the particular flow control valve, as, for example, 36A, 36B, 36C, etc.

Figure 3:
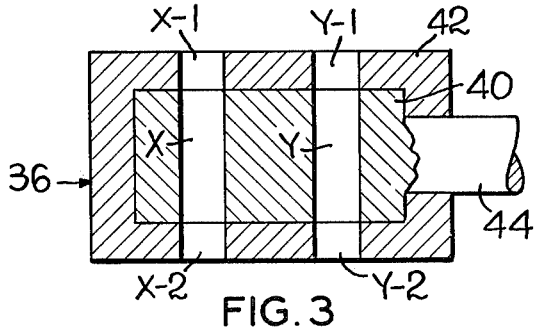
FIG. 3 is a view in longitudinal section of a flow control valve used in connection with the metering and distribution arrangement of the invention.

As best seen in the view of FIG. 3, valve 36 in the illustrated embodiment comprises a cylindrical spool member 40 which is received within and adapted to rotate within a housing or casing 42. Spool member 40 includes a stem portion 44 which extends through the end wall of casing 42. Suitable seal or packing means (not shown) prevents leakage where stem portion 44 extends through casing 42. Spool member 40 of valve 36 is provided with two passages indicated at X and Y which extend diametrically through spool 40 in longitudinally spaced relation to each other. Casing 42 includes a first set of aligned diametrically opposite ports indicated at X-1 and X-2 which are adapted to align with passage X in the rotatable spool member 40 when spool 40 is in the position shown in the view of FIG. 3 and also when spool 40 is rotated 180 degrees from the position shown in the view of FIG. 3. Similarly, casing 42 is also provided with aligned diametrically opposite ports indicated at Y-1 and Y-2 which are adapted to be aligned with passage Y through valve spool 40 when spool 40 is in the position shown in the view of FIG. 3 and also when spool 40 has been rotated 180 degrees from the position shown in the view of FIG. 3. An operating member or cam plate generally indicated at 46 having four radially extending cam arms indicated at 46-1, 46-2, 46-3, and 46-4 is attached to the outer end of stem portion 44. Cam arms 46-1 through 46-4, inclusive, are respectively separated from each other by an angle of 90 degrees. As will be explained in more detail hereinafter, cam arms 46-1 through 46-4, inclusive, cooperate with trip members 70 and 72 located along the peripheral path of rotation of kiln 10 to cause the rotation of valve spool 40 within valve housing 42 whereby to control flow of liquid fuel through valve 36 in a predetermined manner.

Description of Metering Cylinder

In accordance with the invention, a metering cylinder and piston assembly generally indicated at 50 is provided and is suitably mounted on the exterior surface of the rotary reduction kiln so as to rotate with the kiln. The assembly 50 comprises a cylinder member 52 and a "floating" piston member 54 which is linearly movable within cylinder 52. A rod member 56 is fixed to and projects through piston 54 and extends equal distances on the opposite sides of piston 54 whereby rod portions 56A and 56B on opposite sides of piston 54 are of equal length. Rod member 56 moves with piston 54. The opposite ends of rod 56 project through and are movable through suitably sealed passages in the opposite end walls of cylinder 52.

An elongated bracket member generally indicated at 58 is suitably secured to the outer surface of cylinder 52. Bracket 58 includes an elongated portion 58A which is secured to the outer surface of cylinder 52 and extends longitudinally of the longitudinal axis of cylinder 52. Bracket 58 also includes a pair of oppositely disposed end or leg portions 58B and 58C which extend perpendicularly to the elongated bracket portion 58A. Lower leg portion 58C of bracket 58 is provided with a threaded passage 59 which receives an adjusting screw 60 which serves as an adjustable stop for the lower end of rod 56 with respect to the view shown in FIG. 1. Upper leg portion 58B of bracket 58 serves as a stop for the opposite or upper end of rod 56 with respect to the view in FIG. 1.

Adjusting screw 60 is adjusted in threaded passage 59 to adjust the stroke of piston 54 to provide the desired metered quantity of hydrocarbon fuel on each stroke of the piston. For any given position of adjusting screw 60, the stroke of piston 54 is the same in each direction, so that the same metered volume of liquid fuel is delivered by metering piston 54 from cylinder 52 in both directions of movement of piston 54 in any adjusted position of adjusting screw 60.

The space in cylinder 52 above floating piston 54, relative to the view shown in FIG. 1, is connected by conduit 62 to a circular manifold T which encircles rotary kiln 10. Similarly, the space inside cylinder 52 beneath piston 54 is connected by means of conduit 64 to still another circular manifold U.

In examining the schematic arrangement of FIG. 1, it will be noted that the port X-2 of each of the flow control valves 36A–36D, inclusive, is connected by a conduit 66A, 66B, etc. to the fuel supply manifold S. It will also be noted that the port Y-2 of each of the flow control valves 36A–36D, inclusive, is connected by a corresponding manifold conduit 68A, 68B, etc. to the inlet of each of the plurality of nozzles 32 in each particular row of nozzles corresponding to the respective flow control valves 36A–36D, inclusive.

Referring to the schematic arrangement shown in FIG. 1, it will also be noted that the X-1 port of flow control valve 36A corresponding to row A of nozzles 32 is connected to circular manifold T which in turn is connected by conduit 62 to the upper end of the interior of metering cylinder 52 above piston 54. The next successive flow control valve 36B, corresponding to row B of nozzles 32, has the port X-1 thereof connected to circular manifold U which in turn is connected by conduit 64 to the lower end of the interior of cylinder 52 beneath the movable piston 54. Port X-1 of the next successive flow control valve 36C corresponding to row C of nozzles 32 is connected to circular manifold T and thus to the upper end of the interior of hydraulic metering cylinder 52; whereas port X-1 of the next flow control valve 36D which corresponds to row D of nozzles 32 is connected to manifold U and thus to the lower end of the interior of cylinder 52. Thus, it will be seen that the X-1 ports of successive flow control valves 36A, 36B, 36C, 36D, and similarly for the remaining flow control valves 36E–H, inclusive, not shown in FIG. 1, corresponding to the rows of nozzles E–H, inclusive, are connected alternately to the circular manifolds T and U and thus are connected alternately to the upper end and to the lower end of the interior of metering cylinder 52, respectively, above and below the floating piston 54.

In a similar manner, it will be noted that port Y-1 of flow control valve 36A corresponding to row A of nozzles 32, is connected to manifold U and thus to the lower end of the interior of hydraulic cylinder 52, whereas port Y-1 of the next successive flow control valve 36B corresponding to row B of nozzles 32 is connected to circular manifold T and thus to the upper end of the interior of hydraulic cylinder 52 above floating piston 54. In a similar manner, port Y-1 of each of the remaining flow control valves 36C–36H, inclusive, is connected alternately to manifolds U and T and thus alternately to the lower end of the interior of hydraulic cylinder 52 and to the upper end of the interior of hydraulic cylinder 52. In any given flow control valve, such as 36A, 36B, etc., the X-1 port and the Y-1 port are always connected to opposite ones of the circular manifolds T and U. Thus, for example, in the case of flow control valve 36A, the X-1 port is connected to the T manifold and thus to the upper end of hydraulic cylinder 52 and the Y-1 port is connected to circular manifold U and thus to the lower end of hydraulic cylinder 52.

DESCRIPTION OF OPERATION

It is assumed that the stroke of piston 54 in metering cylinder 52 has been adjusted by means of adjusting screw 60 to provide the predetermined desired metered quantity of liquid hydrocarbon fuel on each stroke of piston 54 in metering cylinder 52, as previously described. As previously pointed out, for any given adjustment of the stroke of piston 54, an equal volume of liquid fuel is delivered in each direction of movement of piston 54. Also, the flow rate of the liquid hydrocarbon fuel from supply source 22 to supply manifold S as determined by pressure regulating means PR (FIG. 1) and thus to the respective flow control valves 36 when in "On" position and thus to metering cylinder 52 should be such that the rate of movement of piston 54 in cylinder 52 is such that piston 54 completes its stroke during the time interval in which the particular flow control valve 36 is in the "On" position. This insures that the predetermined measured quantity of fuel is completely dispensed from metering cylinder 52 while flow control valve 36 is in "On" position.

Referring now to FIG. 2, which shows rotary kiln 10 rotating in a counterclockwise direction as shown by the arrow in FIG. 2, it will be seen that an "On" trip member generally indicated at 70 and "Off" trip member generally indicated at 72 are mounted on a support bracket generally indicated at 74 which is supported on the ground or floor surface beneath the lower portion of kiln 10. Bracket 74 includes an arcuate surface 76 which lies on a radius drawn from the center of rotation of kiln 10. The respective trip members 70 and 72 include roller members 70A and 72A, respectively, which are abutments adapted to be engaged by cams 46-1 through 46-4, inclusive, carried by cam plate 46 secured to stem portion 44 of each respective flow control valve 36.

The two trip members 70 and 72 are so located relative to the path of rotation of kiln 10 and of the cam plate members 46 associated with the respective flow control valves 36 that as each respective row A, B, C, etc. of nozzles 32 moves to a predetermined position underneath the bed 18 of metallic oxide which may be in the form of ore or in the form of pellets, one of the cams 46-1, 46-2, 46-3, 46-4 of the cam plate 46 associated with each respective flow control valve 36A, 36B, etc. associated with the respective rows of nozzles will engage the "On" trip member 70. The abutment of cam plate 46 against "On" trip member 70 will then cause a 90 degree circumferential movement of cam plate 46 to cause the corresponding flow control valve 36 to be moved to open position whereby to deliver a predetermined metered quantity of fuel oil or the like from metering cylinder 52 and through the corresponding bank of nozzles 32.

In a similar manner, when one of the cams 46-1, 46-2, etc. of a given cam plate 46 associated with a particular flow control valve 36A, 36B, etc. engages the "Off" trip member 72, the abutment of the cam with the "Off" trip member will cause a 90 degree circumferential movement of the given cam plate 46 to cause the corresponding flow control valve 36 to be moved to closed position whereby to terminate flow of fuel oil through the corresponding flow control valve 36 and through the corresponding row of nozzles It will be noted that in the position of rotary kiln 10 shown in FIG. 2 the row of nozzles D is already under the bed of metallic oxide 18. During the early part of the movement of the row of nozzles D under the bed of material 18, cam 46-1 on cam plate 46D for the rotary spool of the corresponding flow control valve 36D abutted against the fuel-on trip member 70 and caused cam 46-1 to rotate in a clockwise direction relative to the view in FIG. 2, thereby rotating cam plate 46D and the stem 44 connected to rotatable valve spool 40 of flow control valve 36D through an angle of 90 degrees. The 90 degree movement imparted to cam plate 46D and stem 44 caused valve spool 40 to rotate into a position such as that shown in FIG. 3 of the drawings in which passages X and Y of valve spool 40 of valve 36D are respectively in alignment with ports X-1 and X-2 in the case of valve passage X, and are in alignment with ports Y-1 and Y-2 in the case of valve passage Y. Since, as seen in FIG. 1, port X-2 of valve 36D is connected to circular fuel supply manifold S which is mounted on the rotary kiln, the "fuel-on" position of flow control valve 36D causes the hydrocarbon liquid such as fuel oil to flow from circular supply manifold S through conduit 66D to port X-2 of the housing 42 of valve 36D, thence through passage X of valve spool 40 to the diametrically oppositely disposed port X-1 of the valve housing 40, thence through conduit 69D to circular manifold U which is mounted on and carried by the rotary kiln, thence through conduit 64 to the lower end of hydraulic cylinder 52 to cause piston 54 to move upwardly in cylinder 52 until the end of upper piston rod portion 56A (as viewed in FIG. 1) abuts against stop member 58B defined by the upper end portion of bracket 58 relative to the view shown in FIG. 1. This upward movement of piston 54 in cylinder 52 causes hydrocarbon liquid which is already present in the upper portion of cylinder 52 to be ejected through conduit 62 to circular manifold T and thus to port Y-1 of valve housing 42 of valve 36D, thence through flow passage Y in rotary spool 40 of valve 36D, thence through port Y-2 in valve housing 42 of valve 36D and into manifold passage 68D to supply a pulse of liquid hydrocarbon to the plurality of nozzles in row D as the nozzles in row D are moving under the bed 18 of ore or pellets.

As kiln 10 continues to rotate in a counterclockwise direction, with consequent rotation of row D of nozzles 32 in a counterclockwise direction under the bed 18 of material, as viewed in FIG. 1, cam member 46-2 on cam plate 46 of valve 36D will abut against the "Off" trip member 72 causing stem member 44 and the attached rotary valve spool 40 of flow valve 36D to rotate through another angle of 90 degrees to a position in which passages X and Y in the valve spool are no longer in alignment with ports X-1, X-2 and Y-1, Y-2 in valve housing 42. Thus, flow control valve 36D after passing by the "Off" trip member 72 will no longer be open to the flow of hydraulic fluid therethrough.

The next successive row C of nozzles 32 and the flow control valve 36C associated therewith next approaches the "On" trip member 70 in the same manner as previously described and cam member 46-1 of cam plate 46C associated with flow control valve 46C will abut against "On" trip member 70 and will rotate stem member 44 and valve spool 40 of flow control valve 46C through an angle of 90 degrees to move flow control valve 46C to the "On" position similar to that shown in the view of FIG. 3 in which valve passage X is in alignment with ports X-1 and X-2 and valve passage Y is in alignment with ports Y-1 and Y-2.

It will be noted that the position of the "On" trip member 70 and of the "Off" trip member 72 must be so related to each other and to the spacing between successive circumferentially spaced flow control valves such as 36D and 36C that flow control valve 36D must have been actuated to "Off" position before the next successive flow control valve 36C is actuated to "On" position.

It is fundamental to the operation of the liquid fuel metering and distributing arrangement of the present invention that only one flow control valve 36 be in "On" position at any given time, so that at any given time there can be hydraulic flow through only one flow control valve 36.

From an examination of the schematic valving and hydraulic flow distribution diagram of FIG. 1, it can be seen that when flow control valve 36C is in the "On" position the liquid hydrocarbon fuel will flow from main fuel supply manifold S through conduit 66C to port X-2 of flow control valve 36C, thence through flow passage X of rotary spool 40 of valve 36C, to port X-1 of valve 36C, thence through conduit 69C to circular manifold T, thence through conduit 62 to the upper end of hydraulic cylinder 52, causing piston 54 to move downwardly in cylinder 52 to eject a predetermined metered quantity of liquid through conduit 64 to circular manifold U from whence the measured and metered quantity of hydraulic fluid ejected from cylinder 52 then passes through conduit 67C to port Y-1 of flow control valve 36C, thence through flow passage Y in rotatable spool 40 of flow control valve 36C, thence to port Y-2 of flow control valve 36C and thence into manifold passage 68C which distributes the metered quantity of liquid hydrocarbon fuel to each of nozzles 32 in row C of nozzles as the nozzles in row C are passing under the bed of material 18.

When cam member 46-2 of cam plate 46 associated with flow control valve 36C reaches the "Off" trip member 72, cam plate 46 will be rotated through an angle of 90 degrees in the same manner as previously described to cause rotatable spool 40 of flow control valve 36C to rotate to an "Off" position in which the hydrocarbon fuel no longer passes through flow control valve 36C, all in the same manner as previously described in connection with flow control valve 36D.

Thus, it will be seen that as each successive circumferentially spaced row of nozzles 32 reaches a predetermined location under the bed 18 of material to be reduced, a cam on the associated cam plate 46 will be engaged by the "On" trip 70 to rotate valve spool 40 of the associated flow control valve 36A, 36B, etc. to the "On" position in which hydrocarbon liquid is admitted from circular fuel supply manifold S to port X-2 of the corresponding flow control valve 36, permitting liquid hydrocarbon fuel to pass through the flow passage X of the flow control valve to the oppositely disposed port X-1 of the valve housing from whence the hydrocarbon liquid is admitted to one end or the other of metering cylinder 52. The hydraulic connections of alternate flow control valves 36 corresponding to alternate rows of nozzles 32 to metering cylinder 52 are alternated in such manner as to cause liquid hydrocarbon fuel to be admitted to and ejected from alternate ends of metering cylinder 52, whereby to cause piston 54 to be moved in one direction in cylinder 52 when one row of nozzles is passing under the bed of ore and to cause piston 54 to move in the opposite direction when the next successive row of nozzles is passing under the bed of material 18. Thus, the metered quantity of liquid hydrocarbon is admitted to and ejected from alternate ends of metering cylinder 52 as successive rows of nozzles 32 pass under the bed of material 18. The liquid fuel which passes through the ports X-1, X-2 and valve passage X of each respective flow control valve 36 is in a first hydraulic path or circuit which causes piston 54 to move in cylinder 52, while the liquid fuel which passes through the ports Y-1, Y-2 and the valve passage Y of each respective flow control valve 36 is in a second hydraulic path or circuit which delivers the liquid fuel to the corresponding row of nozzles.

From the foregoing description of the invention, it has been shown how the objects of the invention have been obtained in a preferred manner. However, modifications and equivalents of the disclosed concepts such as readily occur to those skilled in the art are intended to be included within the scope of this invention.

The embodiments of the invention in which an exclusive property or privilege is claimed are defined as follows:

1. A rotary reactor comprising an elongated cylindrical chamber adapted to have a charge of material contained therein, a plurality of nozzles supported by said rotary reactor in fluid communication with said chamber, said nozzles being positioned about the periphery of said reactor in substantially equally angularly spaced relation to each other, a separate liquid flow control valve associated with and corresponding to each of said nozzles, each of said flow control valves being mounted on and rotatable with said rotary reactor, a metering cylinder mounted on said rotary reactor and rotatable therewith, a piston member movable in said cylinder in alternately opposite directions to deliver a predetermined measured volume of liquid from said cylinder equally in each direction of movement of said piston member, a first hydraulic circuit interconnecting each of said liquid flow control valves with a liquid fuel supply and with one end of said metering cylinder on one side of said piston member, a second hydraulic circuit interconnecting each of said liquid flow control valves with an opposite end of said metering cylinder on an opposite side of said piston member and with the nozzle corresponding to the given flow control valve, means adapted to selectively move each flow control valve to an "On" position to permit hydraulic flow through said first and said second hydraulic circuits when the given nozzle corresponding to a given flow control valve moves to a first predetermined circumferential position relative to the charge of material in said chamber, and to move each flow control valve to an "Off" position to prevent hydraulic flow through said first and said second hydraulic circuits when said given nozzle moves to a second predetermined circumferential position relative to the material in said chamber, the hydraulic connections of said first and said second hydraulic circuits between said metering cylinder and the flow control valves of alternate circumferentially spaced nozzles being reversed as compared to each other whereby to cause said piston member to move in said metering cylinder in alternately opposite directions to deliver a predetermined measured volume of liquid from alternate sides of said piston to alternate circumferentially spaced nozzles.

2. A rotary reactor as defined in claim 1 in which said reactor is a rotary reduction kiln and said charge of material is a metallic oxide which is to be reduced to a lower state of oxidation.

3. A rotary kiln for reducing metallic oxide to a lower state of oxidation comprising an elongated cylindrical chamber adapted to have a charge of metallic oxide to be reduced contained therein, a plurality of nozzles supported by said kiln in fluid communication with said chamber, said nozzles being positioned about the periphery of said kiln in substantially equally angularly spaced relation to each other, a separate liquid flow control valve associated with and corresponding to each of said nozzles, each of said flow control valves being mounted on and rotatable with said kiln, a metering cylinder mounted on said kiln and rotatable therewith, a piston member movable in said cylinder in alternately opposite directions to deliver a predetermined measured volume of liquid from said cylinder equally in each direction of movement of said piston member, a first hydraulic circuit interconnecting each of said liquid flow control valves with a liquid fuel supply and with one end of said metering cylinder on one side of said piston member, a second hydraulic circuit interconnecting each of said liquid flow control valves with an opposite end of said metering cylinder on an opposite side of said piston member and with the nozzle corresponding to the given flow control valve, means adapted to selectively move each flow control valve to an "On" position to permit hydraulic flow through said first and said second hydraulic circuits when the given nozzle corresponding to a given flow control valve moves to a first predetermined location under the bed of metallic oxide, and to move each flow control valve to an "Off" position to prevent hydraulic flow through said first and said second hydraulic circuits when said given nozzle moves to a second predetermined location under the bed of ore, the hydraulic connections of said first and said second hydraulic circuits between said metering cylinder and the flow control valves of alternate circumferentially spaced nozzles being reversed as compared to each other whereby to cause said piston member to move in said metering cylinder in alternately opposite directions to deliver a predetermined measured volume of liquid from alternate sides of said piston to alternate circumferentially spaced nozzles.

4. A rotary kiln as defined in claim 3 including means for adjusting the stroke of said piston in said cylinder whereby to cause said piston to eject a predetermined precise quantity of liquid from said cylinder on each stroke of said piston, with said precise quantity being equal in both opposite directions of movement of said piston.

5. A rotary kiln as defined in claim 3 in which each of said liquid flow control valves has two independent liquid flow passages therein, one of said passages being in said first hydraulic circuit and the other of said passages being in said second hydraulic circuit, said two liquid flow passages being simultaneously movable to a flow conducting "On" position or alternatively to a flow preventing "Off" position.

6. A rotary kiln as defined in claim 5 in which each of said flow control valves comprises a valve housing and a rotary spool member received within said valve housing, said liquid flow passages being in said rotary spool member, said spool member being rotatably movable within said valve housing to index said flow passages alternately into and out of registry with stationary ports in said valve housing, said passages being in said flow conducting "On" position when said passages are in registry with said stationary ports, said passages being in said flow preventing "Off" position when said passages are out of registry with said ports.

7. A rotary kiln as defined in claim 3 in which each liquid flow control valve carries a corresponding cam means, and in which said means adapted to selectively move each flow control valve to an "On" position and to an "Off" position includes an "On" trip means and an "Off" trip means respectively positioned at appropriate spaced peripheral points contiguous the path of rotation of said kiln, said "On" and said "Off" trip means being adapted to engage the cam means carried by the respective flow control valves as the respective cam means rotate past said "On" and "Off" trip means, whereby to actuate the corresponding flow control valves to "On" and "Off" position at appropriate times during the rotation of said kiln.

8. A rotary kiln as defined in claim 7 in which said flow control valve is a four position valve movable upon successive actuations alternately "Off" and "On," and said cam means comprises a cam plate having four peripherally spaced cams spaced apart 90 degrees of the periphery of said cam plate, said cam plate being operatively connected to said valve whereby each engagement of a cam with said "On" trip means is effective to move said cam plate through a 90 degree peripheral angle whereby to move said valve means from an "Off" position to an "On" position and each engagement of a cam with said "Off" trip means is effective to move said cam plate through a 90 degree peripheral angle whereby to move said valve means from an "On" position to an "Off" position.

9. A rotary kiln for reducing metallic oxide to a lower state of oxidation comprising an elongated cylindrical chamber adapted to have a charge of metallic oxide to be reduced contained therein, a plurality of rows of nozzles supported by said kiln in fluid communication with said chamber, each of said rows extending in a direction parallel to the axis of rotation of said kiln, and each row including a plurality of nozzles spaced apart from each other in said direction, said rows being positioned about the periphery of said kiln in substantailly equally angularly spaced relation to each other, a separate liquid flow control valve associated with and corresponding to each of said rows of nozzles, each of said flow control valves being mounted on and rotatable with said kiln, a metering cylinder mounted on said kiln and rotatable therewith, a piston member movable in said cylinder in alternately opposite directions to deliver a predetermined measured volume of liquid from said cylinder equally in each direction of movement of said piston member, a first hydraulic circuit interconnecting each of said liquid flow control valves with a liquid fuel supply and with one end of said metering cylinder on one side of said piston member, a second hydraulic circuit interconnecting each of said liquid flow control valves with an opposite end of said metering cylinder on an opposite side of said position member and with the plurality of nozzles in the row of nozzles corresponding to the given flow control valve, means adapted to selectively move each flow control valve to an "On" position to permit hydraulic flow through said first and said second hydraulic circuits of the respective flow control valve when the given row of nozzles corresponding to the given flow control valve moves to a first predetermined location under the bed of metallic oxide, and to move each flow control valve to an "Off" position to prevent hydraulic flow through said first and said second hydraulic circuits of the respective flow control valve when said given row of nozzles moves to a second predetermined location under the bed of metallic oxide, the hydraulic connections of said first and said second hydraulic circuits between said metering cylinder and the flow control valves of alternate rows of nozzles being reversed as compared to each other whereby to cause said piston member to move in said metering cylinder in alternately opposite directions to deliver a predetermined measured equal volume of liquid from opposite sides of said piston to alternate rows of nozzles.

10. A rotary kiln as defined in claim 9 including means for adjusting the stroke of said piston in said cylinder whereby to cause said piston to eject a predetermined precise quantity of liquid on each stroke of said piston, with said precise quantity being equal in both opposite directions of movement of said piston.

11. A rotary kiln as defined in claim 9 in which each of said liquid flow control valves has two independent liquid flow passages therein, one of said passages being in said first hydraulic circuit and the other of said passages being in said second hydraulic circuit, said two liquid flow passages being simultaneously movable to a flow conducting "On" position or alternatively to a flow preventing "Off" position.

12. A rotary kiln as defined in claim 11 in which each of said flow control valves comprises a valve housing and a rotary spool member received within said valve housing, said liquid flow passages being in said rotary spool member, said spool member being rotatably movable within said valve housing to index said flow passages alternately into and out of registry with stationary ports in said valve housing, said passages being in said flow conducting "On" position when said passages are in registry with said stationary ports, said passages being in said flow preventing "Off" position when said passages are out of registry with said ports.

13. A rotary kiln as defined in claim 9 in which each liquid flow control valve carries a corresponding cam means, and in which said means adapted to selectively move each flow control valve to an "On" position and to an "Off" position includes an "On" trip means and an "Off" trip means respectively positioned at appropriate spaced peripheral points contiguous the path of rotation of said kiln, said "On" and said "Off" trip means being adapted to engage the cam means carried by the respective flow contro' valves as the respective cam means rotate past said "On" and "Off" trip means whereby to actuate the corresponding flow control valves to "On" and "Off" position at appropriate times during the rotation of said kiln.

14. A rotary kiln as defined in claim 13 in which said flow control valve is a four position valve movable upon sucessive actuations alternately "Off" and "On," and said cam means comprises a cam plate having four peripherally spaced cams spaced apart 90 degrees of the periphery of said cam plate, said cam plate being operatively connected to said valve whereby each engagement of a cam with said "On" trip means is effective to move said cam plate through a 90 degree peripheral angle whereby to move said valve means from an "Off" position to an "On" position and each engagement of a cam with said "Off" trip means is effective to move said cam plate through a 90 degree peripheral angle whereby to move said valve means from an "On" position to an "Off" position.

* * * * *